United States Patent [19]

Mautner et al.

[11] Patent Number: 4,539,727

[45] Date of Patent: Sep. 10, 1985

[54] TOP-MOUNTED DOUBLE-ACTION DOOR HINGE

[76] Inventors: Jacob E. Mautner, 70 E. Front St., Keyport, N.J. 07735; Gerard Crennan, 1 Indian Hill Ct.; Arnold N. Anderson, 6 Wyoming Dr., both of Hazlet, N.J. 07730

[21] Appl. No.: 571,956

[22] Filed: Jan. 19, 1984

[51] Int. Cl.[3] ..... E05F 1/14

[52] U.S. Cl. ..... 16/285; 16/280; 16/277

[58] Field of Search ..... 16/277, 285, 280, 298, 16/299, 301, 357, 361

[56] References Cited

U.S. PATENT DOCUMENTS

| | | | |
|---|---|---|---|
| 325,761 | 9/1885 | Niles | 16/285 |
| 404,556 | 6/1889 | Payson | 16/285 |
| 484,200 | 10/1892 | Held et al. | 16/285 |
| 624,850 | 5/1899 | Niles | 16/285 |
| 839,589 | 12/1906 | Hockstrasser | 16/285 |

*Primary Examiner*—Donald R. Schran
*Assistant Examiner*—James Wolfe
*Attorney, Agent, or Firm*—William T. Hough

[57] ABSTRACT

A double-action hinge for single-hinge top-mounting flexible or semi-flexible doors, of a type mountable on an upright laterally-facing door jamb support, having an axis of hinge-pivot extending uprightly substantially parallel with a mounting door jamb support, with the upper hinge pivot being fixed to a point of and mounting for pivotal rotation as a hinge-mounted door swings to and from in double action through a doorway space framed by a door jamb, and the lower hinge pivot structure being mounted to move freely along an outwardly-extending elongated slot space of a slot-forming lower hinge-support structure permitting a lower end of the hinge axis to move-away from the door jamb support structure when the door swings away from a center position, and an abutting structure having spaced-apart surface portions adjacent the door jamb support structure being mounted on the lower hinge pivot structure fixedly such that the abutting structure turns as the hinge pivots as in opening the door one direction or the other while weight of a hinge-mounted door causes the abutting structure to press toward the door jamb support, with the result that abutting one or the other of the spaced-apart surface portions cause the supported door and lower pivot structure to move outwardly and upwardly when the hinge is swung open, the weight of the door causing the door to swing back toward a centering position, facilitated by one or more coil spring mounted between the rotatable hinge structure and non-rotatable hinge-mounting structure.

14 Claims, 11 Drawing Figures

TOP-MOUNTED DOUBLE-ACTION DOOR HINGE

This invention relates to door-top-mounting double-action hinges.

Double acting self-closing doors commonly utilize two basic hardware designs; gravity cam, or spring return. Either design must be able to operate inwardly and outwardly and must be able to close automatically optimally to a center-position state. The door to function correctly must return to the same position each time is is operated or in the case of the more commonly used double-door panels in the same opening, each panel to function correctly must align itself with the other panel each time it closes, for proper sealing. To operate properly, it must also be able to resist reasonable opening pressures such as that of the wind.

Gravity cam hardware usually consists of an upper and lower hinge assemblies with built-in vertical cams that cause the door to rise when opened. The weight of the door panel, in that type, by virtue of gravity, theoretically forces the hardware to return to the lower position each time. Compression springs are sometimes used as a closing-assist to this design to assist it to function as it is throretically supposed to function. When the door is opened, such spring thereby under-compression accelerates the gravity-closing-force movement back toward a centering-position.

Some double action doors rely on a double spring and a double hinge pin side by side assembled with each spring operating independently of the other. One spring is cocked and therefore provides closing force when the door is opened in one direction and the other spring performs likewise in the opposite direction. The devise returns the door panels to the closed position, but lacks centering adjustment and must have spring tension imposed to support an attached door panel(s) square in the opening.

Singular torsion springs fixed on one hinge single axis have been used by some manufacturers. The singular spring action provides closing force in either direction but this means that the spring is unwound in one direction rather than wound-up-tighter to be cocked; thus, in these, the spring is unwound to create desired closing spring-tension. Unwinding of a spring produces a lesser closing force than if the spring is wound, and to create thereby a closing force by unwinding a spring possibly can cause early spring fatigue or spring breakage or sluggish operating results, one or more thereof. Hardware of this type does not utilize rising cams for closing assistance, in the prior usages, and therefore the speed or workability of the door operation has been totally dependent upon the size of the spring employed. However, size of such spring has been adversely limited by minimal amount of available space in the hardward assembly for the placement of such spring.

The cam or spring design hardward is vulnerable to abuse from striking of the suspended door(s) by freight floor-trucks passing through the door-jamb opening, in that both designs require hardware components fastened to the lower vertical jamb of the door opening. This type of hardware also requires rigid or semi-rigid door panel assemblies which tend to fail faster than totally flexible or semiflexible, more-yielding door panels, when subjected to abuse by typically such truck-traffic and abuses thereof.

Precise hardware alignment and extensive lubrication are usually prerequisites for proper double acting door hardware operation. Overly large size or heavy door panels can cause doors to operate sluggishly or stay partially open at the centering position because of excessive weight that increases friction imposed on moving parts. Also heavy doors mounted on complex or large numbers of interacting parts, cause a quick wearing-out and malfunctioning of such hinge.

Top mounted hardware having no lower hardware, but using similar spring and cam designs, is also used for double action doors and has similar performance limitations as the previously described designs above. Manufacturers of rigid door panels cannot effectively use their products with this design. The design is primarily limited to totally flexible or semi-flexible door panels. As already stated-above, gravity cams and/or compression springs have been the usual methods of creating operating momentum toward closing bottom mounted hardware doors. However, without lower hinge hardware for weight distribution and balance, the concentrated weight and friction imposed on top mounted hardware is even greater than found in the top and bottom hardware where these forces are spread-out and distributed between the upper and lower positions of the door jamb to which the hardware is fastened.

THE OBJECTS

Objects of this present invention include to provide double acting door hardware that is heavy duty, quick acting, easy to operate and maintain, and can effectively and automatically seal-off an opening with attached door panel(s).

Ideally, hardware should present a low profile, up and out of the way of destructive forces imposed by operating equipment passing through the door opening.

Additionally, the need exists for door hardware to effectively handle much larger and heavier sized door panel(s) than is currently available in the industry.

Another object is to avoid and/or obviate problems and difficulties above-noted of prior hinges heretofore available.

Another object is to achieve a smooth positive action of the door panel(s) in returning from open state to centered closed state.

Another object is to achieve or obtain one or more preceding objects by a design and combination of simple and inexpensive nature such that the resulting hinge(s) might be competitively priced, making available the advantages at economical prices in the eventual sale thereof.

Another object is to virtually eliminate shaft wear that is absorbed by the special cam block attached to the shaft.

Another object is to provide easily adjustable door panel-centering mechanism of the adjustable cam block.

Other objects become apparent from preceding and following disclosure. One or more objects of the invention are obtained by the invention as described herein.

Among the above-discussed problems, the inventors in the working on models arriving at the present invention, encountered many of the same problems, for example difficulty in arriving at a top-mounting hinge that under the weight of a large and heavy flexible door, closes to the centered or aligned position and state by a smooth and positive action without reluctance nor hesitation.

BROAD DESCRIPTION

The new hardware of the present invention described herein, satisfies all of the above-noted objects, being unique and original in its operating design.

The cam of the inventive combination operates laterally rather than vertically, the cam being an abutment structure. The operating hinge shaft(s) and/or pivot pin(s) pass through a squared cam at a lower end of the hinge combination. The flat back or spaced-apart abutment portions of the cam block typically rest against the lower flat portion of the hardware base plate that extends between the oppositely-spaced pivot pin or hinge-support structures. Rotation of the operating shaft or hinge on either of the abutting-structure's squared or spaced-apart corner portions causes the lower end on which the cam is mounted, to move outwardly and slightly upwardly as the hinge or door rotates away from a centered state and position, by virtue the lower hinge-support structure having formed therein an elongated slot extending laterally outwardly from the base plate and/or upright door jamb support, permitting the lower hinge-shaft end or pivot-pin to ride within the slot-space of the slot while continuing to support the hinge. The force of door weight pulls down the hinge arm on which the door is mounted; preferably a spring is also present and the spring of increased, wound spring tension, together with the hinge tending to swing-back to a lower position for its suspended weight, jointly cause the hinge axis and/or pivot pin(s) to rotate in a return-direction toward a centered state and position, after each opening of the door or turning of the hinge from the at-rest position and state.

Broadly the invention may be described as a hinge combination of which for hinge support structures mounted one above the other on typically a door jamb surface for mounting a hinge shaft or pins at opposite ends of the movable hinge structure extending parallel to the upright door jamb support structure, a lower end of the movable hinge or hinge shaft or pin includes a cam abutment structure of which at least spaced-apart portions thereof are pressed against either the face of the door jamb or the upright flat surface of the base plate of the hinge support while the lower hinge support structure includes an outwardly extending slot such that the hinge shaft or lower pin may ride therein while concurrently supporting the movable hinge. Thereby, when the hinge and shaft or pin(s) thereof rotate from a center position in either of door-opening directions for a double-action hinge, the abutting spaced-apart portions, one or the other, cause the bottom of the hinge or bottom of the hinge shaft or pin to be pushed laterally outwardly with the result that the door becomes raised or elevated away from the door jamb support at a lower end of the door. As a result of this movement, the center of gravity and weight of the door mounted on the movable hinge tend to swing-back to the centered state and position.

In a preferred embodiment, there is included at least one coil spring extending along a longitudinal axis of the hinge shaft or longitudinal axis of the movable hinge and base plate's flat surface, having one end mounted on the support structure at one end or on the base plate thereof or the like, and having an opposite end mounted on the movable hinge structure, with the spring biasing the hinge toward the centered position and state. In a further preferred embodiment, there are two coil springs extending substantially coaxially to one-another, appropriately mounted separately.

Preferably while the upper end of the movable hinge structure is typically mounted in a set position pivotably rotatable as an upper pin of the movable hinge, the lower end of the hinge structure includes a pivot pin mounted on and extending axially therefrom into the slot-space of the elongated slot formed in the lower hinge support structure as an outwardly-extending flange extending laterally from the upright door jamb structure.

The upper and lower hinge support structure portions, normally and preferably upper and lower laterally extending flanges, are preferably interconnected at their bases by a common and fixed interconnecting base plate structure having a flat surface at least adjacent to and facing the abutting spaced-apart portions of the cam abutment structure mounted at the lower end of the movable hinge structure typically on the lower pin. More preferably the exposed surface of the base plate exposed to space within the door jamb doorway frame, is planar in nature as a planar surface extending along a plane parallel to the upright surface of the door jamb structure.

In another preferred embodiment, the abutting portion is merely a base-extension of the lower portion of the movable hinge structure, preferably as an inwardly-directed squared end of the hinge movable structure, with the squared portion being pressed against typically the planar or flat surface of the base plate, or of a flat upright door jamb structure extending between the upper and lower hinge-support structures.

In still another preferred embodiment, each of the spaced-apart abutting portions include a roller structure such that the abutting portions move smoothly along the planar or flat surface of the base plate of upright door jamb face, as the case may be.

In another preferred embodiment, the movable hinge structure at at-least one end thereof that mounts an end of a coil spring, has a rotatable detachable part, normally locked in a non-rotatable state, such that when unlocked or unsecured, it by rotation thereof may be rotated to tighten or loosen coil spring tension, then relocked or resecured. Likewise, at least one portion of the hinge-mounting support structure on which an end of the coil spring(s) is or are attached, includes preferably a rotatable detachable part which is normally locked or secured, that may be unlocked or unsecured allowing it to be revolved to tighten or loosen tension of the coil spring(s).

As noted above, one preferred embodiment includes two coil springs on a single axis, and as above-noted there may be for each spring the individual adjustment structure for adjustment of spring tension. One spring provides the closing force in one direction, and the second spring provides the closing force in the other direction. Even with such an arrangement however, the spring forces are greatly diminished when the movable hinge structure or hardware—including the door mounted on the movable hinge structure, is in the nearly closed position. Thus, the unique abutting structure and movable pin in the elongated slot-space of this invention provide a major force causing the movable hinge and door mounted thereon to continue to move to a centered state and position, the spring(s) tension(s) and this hinge-arrangement and structure serving to supplement each other, with the preferred result of exceptionally effective and smooth operation, maintaining a centered state and position at all times.

The invention may be better understood by making reference to the following Figures.

THE FIGURES

Figure 4:
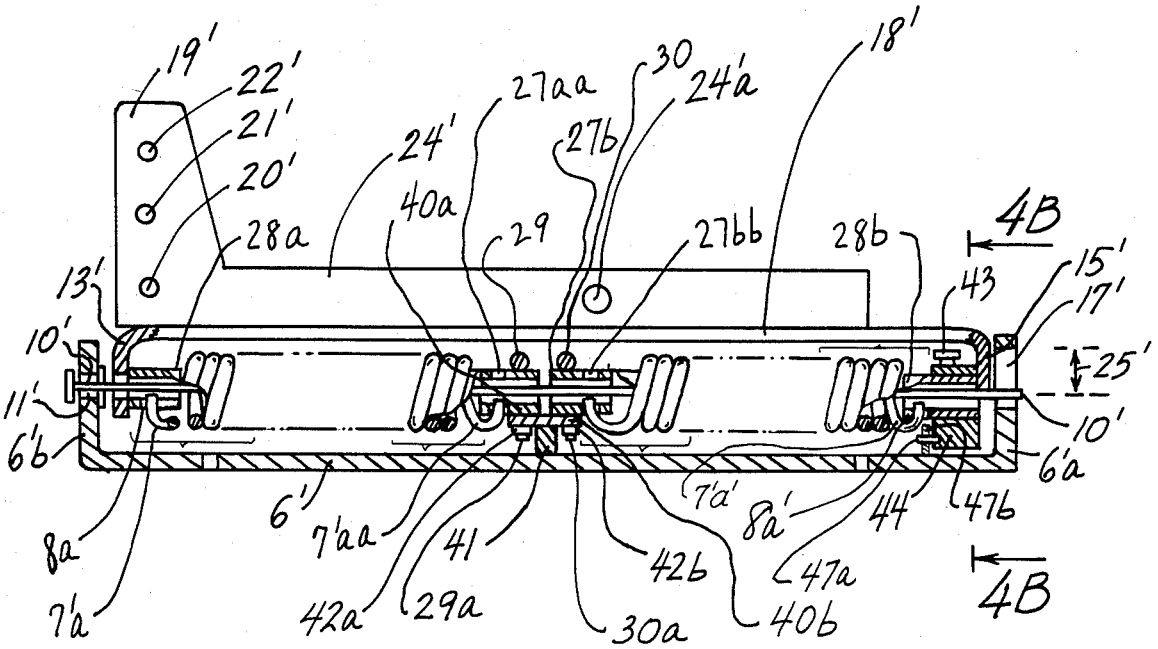
FIG. 4 illustrates a preferred two-spring embodiment in an in-part cross-sectional side view diagrammatically showing the hinge with its top portion at the left and its bottom end at the right, and the illustration being in-part in exploded view.
Figure 4A:
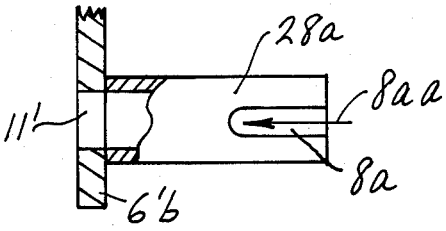
FIG. 4A illustrates a typical spring-mounting element as a part of the left or top end of the movable hinge structure as illustrated in FIG. 4, in an in-part cross-sectional side view.
Figure 4B:
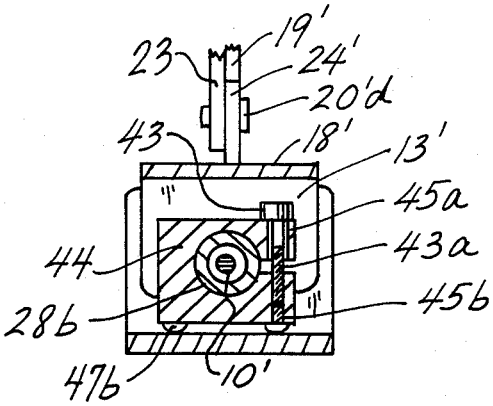

FIG. 4B also in an in-part cross-sectional side view as taken along line 4B—4B of FIG. 4 illustrates diagrammatically the bottom end of the hinge, particularly helpful in showing the mechanism of the cam abuttment member with its rollers and the unlockable nature thereof for adjusting door centering or location of the door panel in the closed position.

Figure 5:
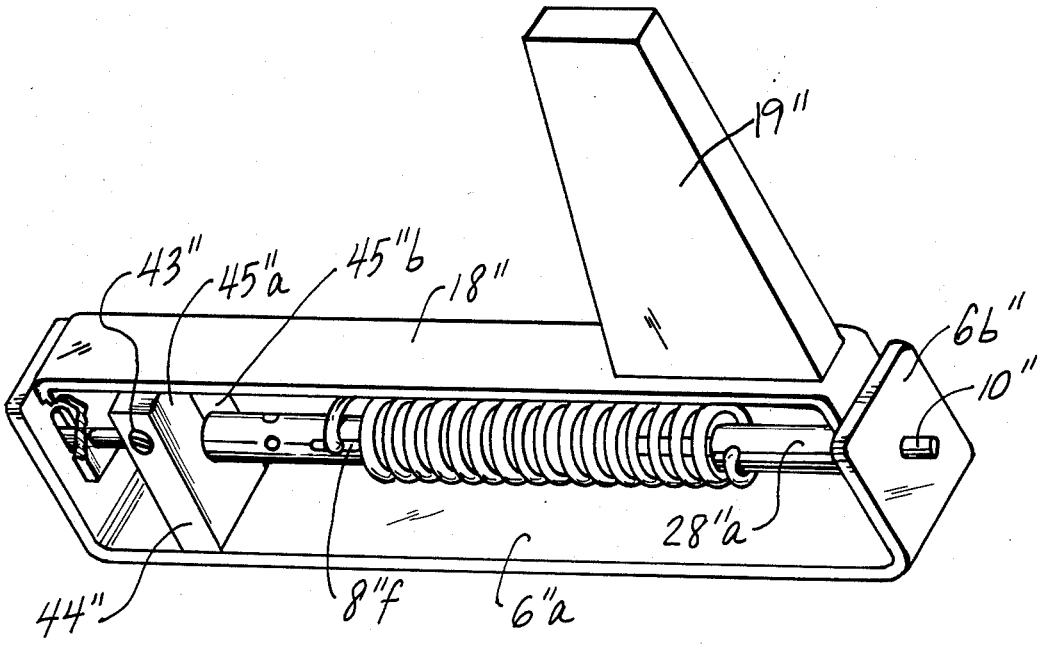

FIG. 5 illustrates a different single-spring embodiment of the invention in side perspective view showing the hinge top on the right and the hinge bottom on the left, with partial cut-away for improved illustration.

Figure 6:
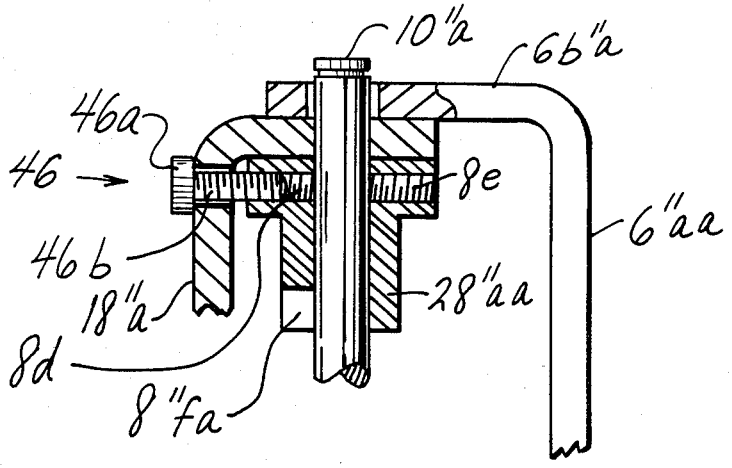

FIG. 6 illustrates in an in-part view, a different embodiment otherwise like either of embodiment of FIG. 5 or variations thereon, as a different mechanism for anchoring the adjustable spring-mounting and adjusting-of-tension revolvable structure as a part of the movable hinge structure of a top end of the hinge structure as a whole, shown in partial cut-away and cross-sectional view.

Figure 7:
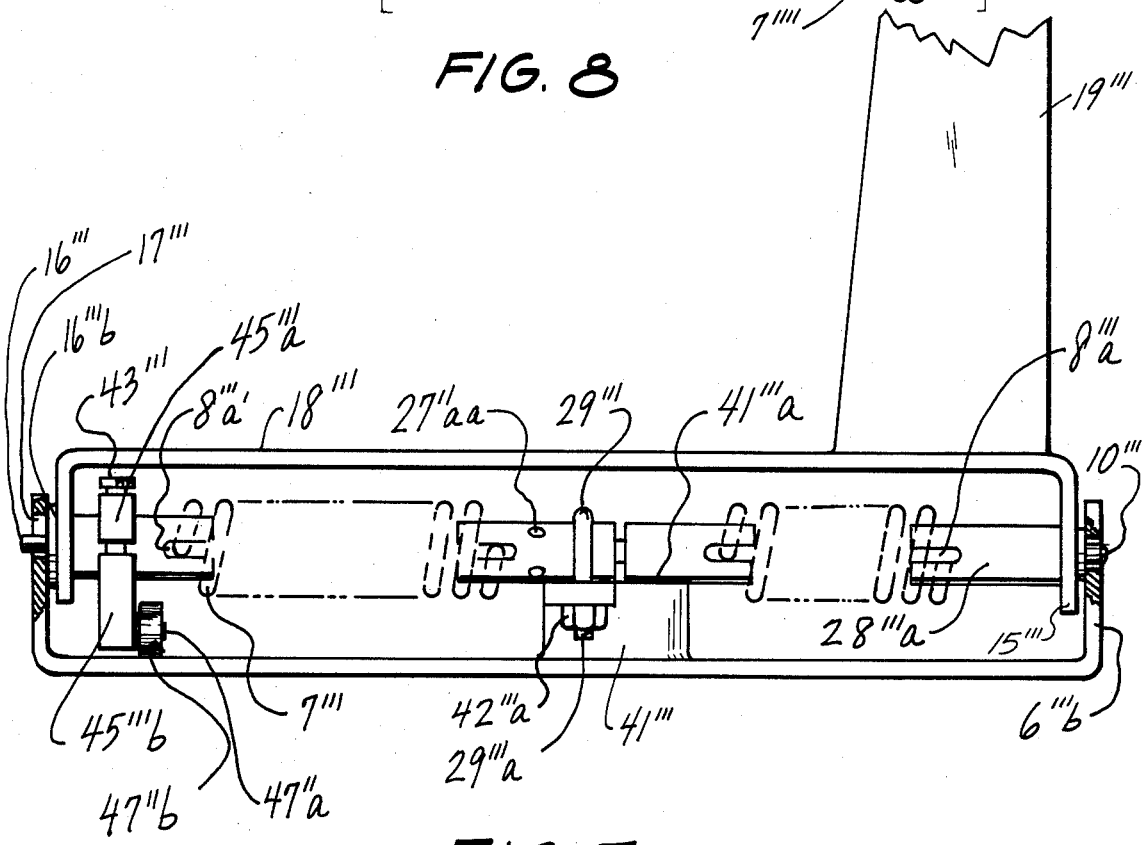

FIG. 7 illustrates diagrammatically in side view with part cut-away cross-sectional view, a different two-spring embodiment of the inventive hinge.

Figure 8:
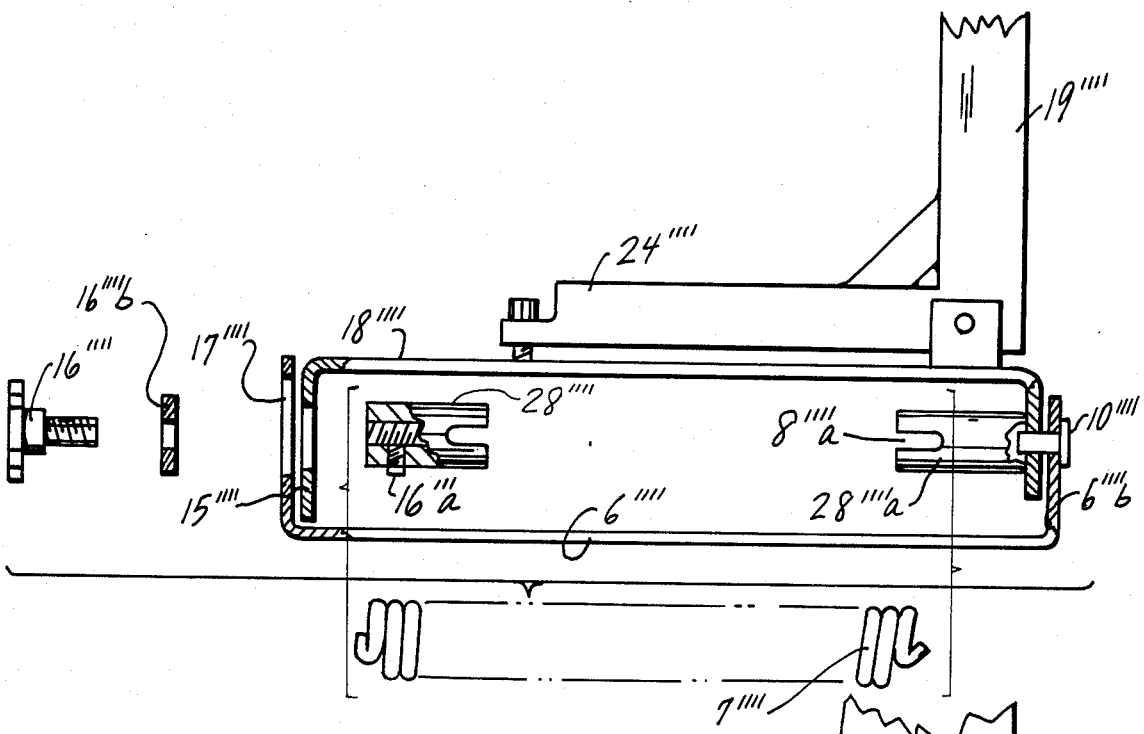

FIG. 8 illustrates diagrammatically in side exploded and in-part cross-sectional cut-away view a different single-spring embodiment of the invention.

DETAILED DESCRIPTION

In further reference to the above-noted Figures, to facilitate a recognition of comparable parts or elements and features of the several different embodiments illustrated, common indicia variations are used for identifying basically-similar or identical parts, elements and the like, and once described for one embodiment are not repeated for other embodiments except for special further explanation to improve understanding.

Figure 1:
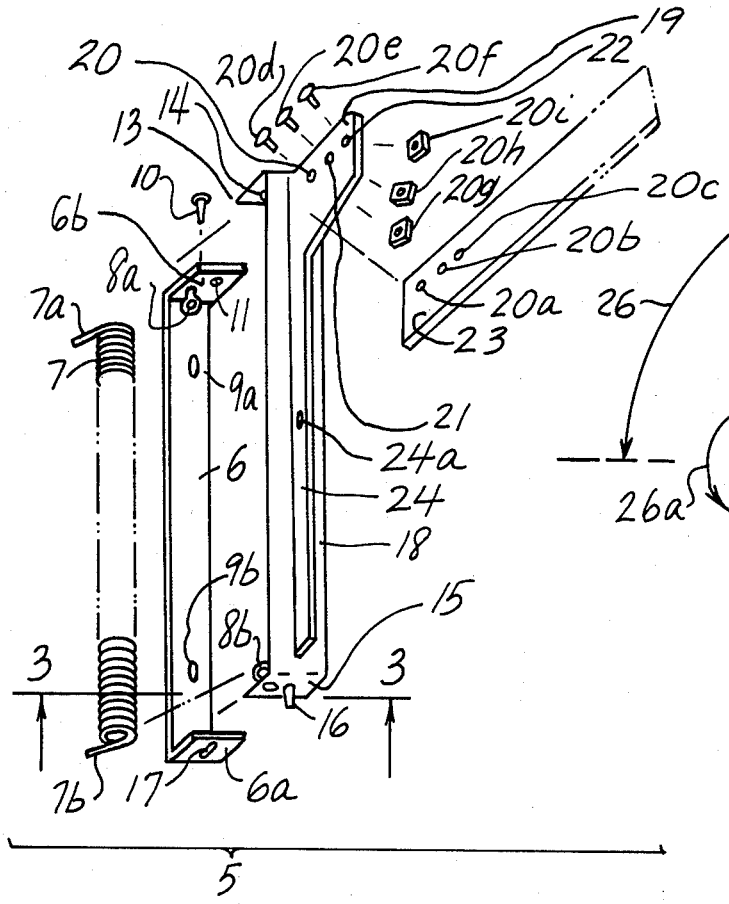
FIG. 1 illustrates in exploded perspective side view a single-spring embodiment of the invention, also including door-mounting hardware of a laterally-extending arm or plate from which a flexible or semi-flexible door or curtain would be suspended.

FIG. 1 illustrates the hinge combination 5 having base mounting plate 6 with its bottom flange 6*a* and top flange, with a spring 7 having its end 7*a* mountable in flange-anchored ring 8*a* and having its end 7*b* mountable in movable hinge-structure anchored ring 8*b* of the movable hinge structure-element 18 with its downwardly-extending short upper end 13 and its downwardly-extending long and squared lower end 15 having pin 16 mounted thereon extending axially downwardly. Hinge-mounting upwardly-extending top structure or flange 6*b* has aperture 11 through which fixed-position but revolvable pin 10 extends into its fixed-mounting state and position mounted on movable hinge downwardly-extending structure 13 within its aperture 14. The pin 16 is mounted in and laterally movable within and along the slot 17 extending laterally outwardly along the outwardly-extending lower hinge-mounting flange-structure 6*a*. Mounted on the movable hinge structure-element 18 is a laterally-extending arm-mounting element 19 having screw apertures 20, 21, and 22 receivable of screws 20*d*, 20*e* and 20*f* lockable by nuts 20*g*, 20*h* and 20*i* after mounting door-suspending bar or plate 23 by the screws through apertures 20*a*, 20*b* and 20*c*. The flange-member 24 also extends laterally from the movable hinge structure-element 18 and has its aperture 24*a* for the anchoring of a flexible or semiflexible door of which the top thereof typically includes a loop type structure that slips around the top bar or plate 23 above-described. Anchoring at aperture 24*a* prevents the loop-containing door or curtain from slipping off the bar or plate 23 laterally.

Figure 2:
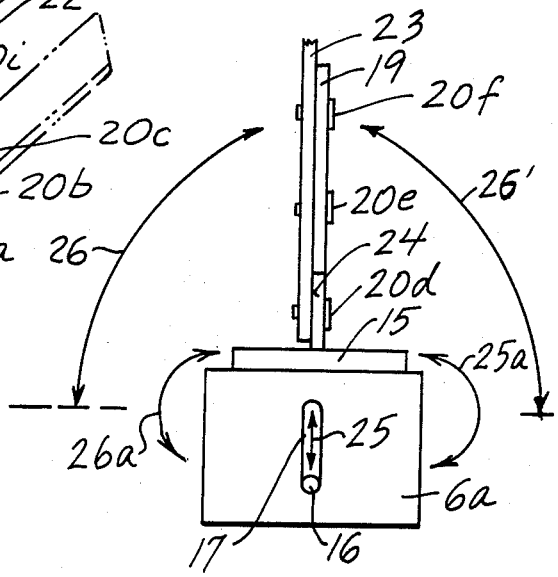
FIG. 2 illustrates a bottom end view of the FIG. 1 embodiment.

FIG. 2 better shows the mounted assembled state of the elements of the FIG. 1 embodiment, particularly well illustrating the direction 25 of movement of pin 16 as the hinge is revolved or pivoted in either of alternate directions 26 or 26′.

Figure 3A:
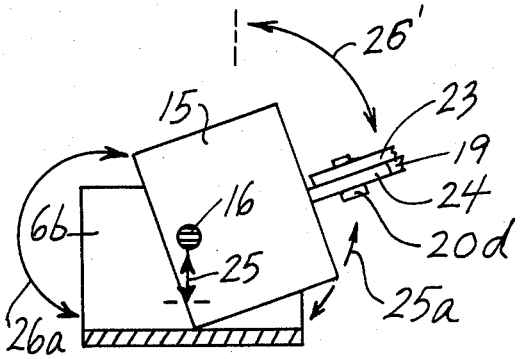
FIG. 3A illustrates another illustrative view diagrammatically, of the same view and embodiment as that of FIG. 3, except illustrating typical appearance and position when the movable hinge structure has been swung from a centered position to an open-door position.
Figure 3:
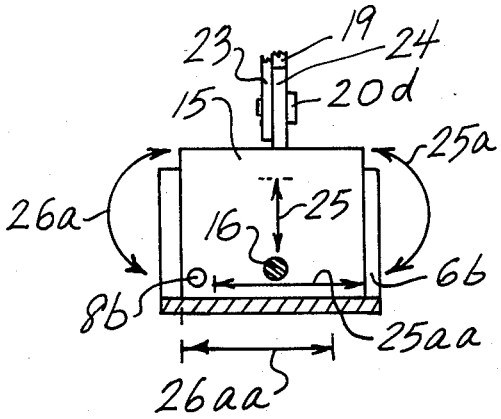
FIG. 3 illustrates an in-part cross-sectional bottom end view of FIG. 1 embodiment as taken along line 3—3 of FIG. 1.

FIG. 3 illustrates the same embodiment and position as that of FIG. 2 except taken along line 3—3 of FIG. 1 and illustrating the distance of movement of either of the bottom squared-corners of the downwardly-extending squared hinge-end 15 of the movable hinge structure as distance 25*aa*, and like FIG. 2 showing the line of pivotal travel 25*a* and 26*a* of the squared hinge-end 15 of which the bottom squared corners constitute the abutting spaced-apart portions of the the abutment structure which in this embodiment is the squared downwardly-extending movable hinge structure end 15 already above-described. Accordingly, the contact and abutting functioning thereof with concurrent upward movement of the pin 16 is illustrated in FIG. 3A as the hinge has been pivoted to the right, as viewed from the bottom of the hinge in its in-part cross-sectional view taken along the same line 3—3 as that of the FIG. 3.

FIGS. 4 and 4A and 4B jointly illustrate a common embodiment. Rotatable (revolvable) spring-mounting and tension-adjusting elements 27*b* separately secured by U-clamps 29 and 30 by U-clamp-ends 29*a* and 30*a* and mounted nuts 42*a* and 40*b* respectively, onto base-plate anchoring-structure 41. The elements 27*b* have holes to receive rods (not illustrated) or screwdriver-end or the like, by which the elements by pressing downwardly or lifting on such rod anchored in typical holes 27*aa* or 27*bb* may adjust and thereby tighten or loosen spring tension for the respectively mounted springs. At opposite ends of the illustrated two springs, the ends of the springs are mounted, such as spring-end 7′*a* in opened slot 8*a* and spring-end 7′*a*′ in open-ended slot 8*a*′, and the anchored-ends of the springs such as spring-end 7′*aa* anchored in holes such as 27*aa*. The movable hinge structure of this embodiment includes the spring-mounting structures 28*a* and 28*b* anchored thereon, the structure 28*a* being fixedly, non-rotatably welded thereon, but the structure 28*b* being adjustably-secured by lock screw 43 of abutment structure 44 welded to the downwardly-extending hinge-structure 15', with the screw 43 locking-together tightly the abutment structures 45*a* and 45*b* by the male-threaded shaft anchored in female threads of the aperture in the 45*b*-structure. Both FIGS. 4 and 4B illustrate the rollers 47*b* mounted by pins such as pin 47*a* on structure 44. The FIG. 4A better illustrates the element 28*a* with its open-ended slot 8*a* into which a spring-end 7'*a* moves in direction 8*aa* to become thereby anchored as illustrated in FIG. 4.

In the FIG. 5 illustration, instead of separate pins at each of opposite ends, and likewise in the FIG. 4 embodiment, there is a pin that extends as a shafts all the way from its mounting aperture in lower-end support flange-structure to the opposite end and into the elongated-slot space of the upper-end support flange-structure, with the shaft appropriately anchored so as not to slip-out from its mounting positions, anchored normally at the upper end. In FIG. 4, the head thereon prevents the shaft from slipping down, while in FIG. 5 the shaft 10'' may typically be wedge-fitted or welded into the flange-structure's (6*b''*) aperture mounting the shaft 10'', for example.

In the FIG. 6, spring-adjustment structure 28''*a* locks onto the shaft 10''*a* and it revolves as the hinge movable structure pivots in a revolving motion, with the shaft or pin 10''*a* mounted in its mounting aperture in upper hinge-support flange 6*b''a*. When the lock screw 46 is loosened, a rod inserted into aperture 8*e* may be used to revolve the structure 28''*aa* to tighten or loosen tension of a spring having its spring-end anchored in open-ended slot 8''*fa*. By tightening on the screw head 46*a*, the threaded shaft 46*b* screws into the female-threaded aperture 8*d*.

Except for the exploded-view embodiment of FIG. 8 having a different type lock-nut 16'''*a* to anchor its spring-anchoring structure onto the pin 16'''' mounted through washer 16''''*b* by the pin's male threaded shaft anchored within the female-threaded member 28'''' by the lock-nut 16'''*a*. Also a different arrangement of mounting the laterally-extending arm-mounting element 19'''' and flange member 24'''' are illustrated, as an obvious variation or modification from that illustrated in FIG. 1.

FIG. 7 corresponds substantially to the embodiment of the above-described FIG. 4, except for the weld-point 4*a'''a* anchoring the spring-anchoring element to the base-plate structure 41'''. The top-end spring anchoring hinge-structure 28'''*a* is welded to the downwardly-turned and extending short movable hinge end 15'''.

While the hinge-support flanges are not necessarily connected by an interconnecting intermediate base plate, the interconnecting base plate is preferred. In any event, the flanges and/or base plate are in use of the hinge combination of this invention, mountable on a flat inwardly-facing door-jamb upright structure such that the hinge combination is within the space of the door jamb, with the hinge longitudinal axis extending also upwardly and downwardly substantially parallel with a surface of the door jamb that is inwardly facing, as typically normally mounted.

Spring adjustment is best demonstrated in the two spring embodiment such as the embodiment of FIG. 4. Each spring is adjusted by loosening the applicable U-bolt and rotating the sleeve to which the spring is attached at that point.

Spring adjustment in the single spring embodiments are primarily to neutralize spring tension in that with one spring, an adjustment in one direction tends to cause hardware to open in that direction or increase the closing force in that same direction. Increasing spring tension in the single spring embodiment, is useful to overcome typically a force on one side such as may be caused by wind or air circulation. The closing force of a single spring embodiment, with the spring adjusted in the neutral position, is dependent solely on the return strength of the spring after the door is opened.

For the present invention, the springs illustrated are primarily used to return the door to the point of closing where the cam energized by the weight of the door can take off the necessary closing force. At the closing point, the springs have theoretically cancelled each other out. The springs perhaps do the job best, but there are mechanical equivalents—within the scope of this invention—such as vertical blocks of rubber or flat metal shapes that when twisted, seek to recover (memory) to the original position and therefore, act like springs and can be substituted for the springs as spring-mechanisms.

It is within the scope of the present invention to make variations and modifications and substitution of equivalents and the like, as would be apparent to a person of ordinary skill in this particular art.

In a patentability search, no relevant prior art was located.

We claim:

1. A hinge device consisting essentially of first and second spaced-apart hinge-support structures each mountable on an inwardly-facing surface of an upright door jamb-structure, a hinge structure having opposite hinge members mounted on the first and second hinge-support structures, a first hinge-mounting means pivotably mounting one hinge member on the first hinge-support structure, a second hinge-mounting means pivotably mounting the opposite member on the second hinge-support structure, at least one coil-spring having one spring-end thereof mounted on one end of said first and second hinge-support structures and having an opposite spring-end thereof mounted on one of said hinge member, the improvement comprising said first hinge-mounting means including one of a pivot pin and an elongated slot-forming structure and an elongated slot-space thereof, and the first hinge-support structure including the remaining one of the pin and the elongated slot-forming structure, said slot-space extending in a direction substantially transversely to a longitudinal axis of said coil spring, said pivot pin being transversely-movably mounted in said slot-space, said one of said pivot pin and said elongated slot-forming structure being mounted as a part of a first end of the hinge structure, and said remaining one of said pivot pin and said elongated slot-forming structure being mounted as a part of said first support structure, and an abutting portion of at least one of said hinge-mounting means and said first hinge-member including abutting means having spaced-apart surface portions positioned along a plane substantially parallel to a second axis extending between the first and second hinge-support structures and in juxtaposition thereto such that the abutting portion contacts and is movable-along a flat surface extending along said axis when the hinge structure is revolvably pivoted.

2. The hinge device of claim 1, in which said one spring-end is mounted on said second hinge-support structure and in which said opposite spring-end is mounted on said one hinge member, and in which said pivot pin is a part of said first hinge-mounting means and mounted on one hinge member and extending into said slot-space, and in which the first support structure includes the slot-forming structure and the elongated slot-space thereof, and said abutting portion being a part of said hinge-mounting means.

3. The hinge device of claim 2, including a planar surface having a surface structure interconnecting and extending between the spaced-apart surface portions with the planar surface extending along said plane.

4. The hinge device of claim 3, in which the first and second spaced-apart hinge-support structures each include a base portion, and in which said flat surface is attached to and extends between base-portions of said first and second spaced-apart hinge-support structures.

5. The hinge device of claim 1, in which said abutting portion is a part of said one hinge member.

6. The hinge device of claim 1, including at least one roller element mounted on said abutting means adapted for rolling said abutting means along the flat surface.

7. The hinge device of claim 2, in which said hinge-mounting means includes a lockable detachable revolvable spring-mounting means adapted for permitting tightening or loosening of a coil spring having one end thereof mounted on one hinge member.

8. A double-acting heavy-duty spring-biased door-hinge device comprising in combination: mounting means for supporting spring and hinge elements, having door-jamb-mounting structure adapted to be mounted on a substantially upright inwardly-directed door-jamb surface, and having spaced-apart substantially parallel first and second flanges extending in a common direction from the door-jamb-mounting structure, and for each of the flanges there being a pivot means providing a pivot pin and a pivot-pin-receiving space positioned for mounting opposite ends of a hinge-structure by the pivot pins at opposite ends thereof, said flange having a base, at least a first one of the pivot-pin-receiving spaces at said first flange being formed as an elongated slot extending in said common direction toward a base of the flange adapted for the pivot-pin to move transversely therein when a hinge-structure is supported thereby on said first flange, a hinge-structure at a first-end thereof being mountable by said pivot means on said first flange by a first pivot-pin extending axially substantially parallel with a longitudinal axis of a length of the hinge-structure adapted for pivot thereon of the hinge-structure, the first pivot-pin being mounted and ridable within said elongated slot in a direction transverse to the longitudinal axis of the first pivot-pin, said door-jamb-mounting structure at said first-end one of said flanges having a substantially flat surface extending substantially transversely across a longitudinal axis of the door-jamb-mounting structure such that the substantially flat surface is substantially parallel to the inwardly-directed door-jamb surface when mounted, said hinge-structure including an abutting means having abutting-structure at said first flange positioned at at-least two spaced-apart points along a plane substantially parallel to said substantially flat surface and in juxtaposition thereto such that one or the other of said spaced-apart abutting structure portions contact and slide along the flat surface when the hinge-structure is revolved pivotally in one of opposite directions on said first pivot pin whereby the first pivot-pin moves transversely in said elongated slot, and at-least one coil spring means extending in a direction substantially parallel to axes of each of said door-jamb-mounting structure and an opposite end of the coil spring means mounted on said hinge structure.

9. The door-hinge device of claim 8, in which the coil spring means includes first and second coil springs axially aligned having adjacent end of the first and second coil springs mounted on said door-jamb-mounting structure and opposite ends thereof mounted one thereof on said first flange and another thereof on said second flange.

10. The door-hinge device of claim 9, in which said hinge-structure at said first end includes a lockable detachable revolvable spring-mounting means adapted for permitting tightening and loosening of coil spring tension of the coil spring having one end thereof mounted on said spring-mounting means.

11. The door-hinge device of claim 9, in which spring-mounting structure is a part of said door-jamb-mounting structure and includes a lockable detachable revolvable spring-mounting means adapted for permitting tightening and loosening of coil spring tension of the coil spring having one end thereof mounted on said door-jamb-mounting structure.

12. The door-hinge device of claim 8, including at least one roller element mounted on said abutting means adapted for rolling said abutting means along said flat surface.

13. The door-hinge device of claim 8, in which said hinge structure includes door-mounting means for suspending a door-like structure of a curtain on the hinge structure.

14. A door-hinge device comprising in combination: first and second spaced-apart hinge-support structures each mountable on an inwardly-facing surface of an upright door jamb-structure, a hinge structure having opposite first and second hinge-ends mounted on the first and second hinge-support structures, a first hinge-mounting means pivotably mounting the first hinge-end on the first hinge-support structure, a second hinge-mounting means pivotably mounting the second hinge-end on the second hinge-support structure, said first hinge-mounting means including one of a pivot pin and an elongated slot-forming structure and an elongated slot-space thereof, and the first hinge-support structure including the remaining one of the pin and the elongated slot-forming structure, said slot-space extending in a direction substantially transversely to a longitudinal axis of said hinge structure, said pivot pin being transversely-movably mounted in said slot-space, said one of said pivot pin and said elongated slot-forming structure being mounted as a part of said first end of the hinge structure, and said remaining one of said pivot pin and said elongated slot-forming structure being mounted as a part of said first support structure, and an abutting portion of at least one of said first hinge-mounting means and said first hinge-end including abutting means having spaced-apart surface portions positioned along a plane substantially parallel to a second axis extending between the first and second hinge-support structures and in juxtaposition thereto such that the abutting portion contacts and is movable-along a flat surface extending along said second axis when the hinge structure is revolvably pivoted.

* * * * *